US005096313A

United States Patent [19]

Horii

[11] Patent Number: 5,096,313

[45] Date of Patent: Mar. 17, 1992

[54] DOT PRINTER HEAD

[75] Inventor: Masami Horii, Shizuoka, Japan

[73] Assignee: Tokyo Electric Co., Ltd., Tokyo, Japan

[21] Appl. No.: 707,900

[22] Filed: May 30, 1991

[30] Foreign Application Priority Data

May 31, 1990 [JP] Japan ..... 2-142816

[51] Int. Cl.[5] ..... B41J 2/25

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,447,166 | 5/1984 | Ochiai et al. | 400/124 |
| 4,555,192 | 11/1985 | Ochiai | 101/93.05 |
| 4,624,589 | 11/1986 | Ochiai et al. | 400/124 |
| 4,941,761 | 7/1990 | Ogawa et al. | 400/124 |
| 4,976,554 | 12/1990 | Shimosato et al. | 400/124 |
| 5,009,528 | 4/1991 | Horii et al. | 400/124 |

*Primary Examiner*—Edgar S. Burr
*Assistant Examiner*—Lynn Hendrickson
*Attorney, Agent, or Firm*—Oblon, Spivak, McClelland, Maier & Neustadt

[57] ABSTRACT

A dot printer head including a housing that contains electromagnets toward its back end, the electromagnets having cores positioned opposite to armatures which are supported detachably against the core. The housing slidingly supports needles connected to the armatures and pushed in retracting direction thereof. An armature stopper made of an elastic substance is fixedly attahced to the inside of a cover which closes the opening at the back end of the housing, the armature stopper being in contact with the vicinities of the free ends of the armatures. A spacer is made of a substance with a linear expansion coefficient such as to ensure the same expansion as that of the armature stopper in thickness, the spacer connecting the inside of the cover to the opening edge of the housing. In this setup, when the armature stopper extends in thickness in keeping with the temperature rise inside the housing during printing, the spacer expands by exactly the same thickness to retract the cover. This allows the armatures to return always to the same position.

11 Claims, 3 Drawing Sheets

DOT PRINTER HEAD

BACKGROUND OF THE INVENTION

1. Field of the Invention

The present invention relates to a printer head of a printer that prints onto recording paper and, more particularly, to an impact type dot printer head that operates on a pixel printing method.

2. Discussion of the Background

FIG. 3 illustrates a typical conventional dot printer head. In FIG. 3, reference numeral 1 is a housing that has an opening 2 on one side thereof. The housing 1 contains a base 3 and a plurality of electromagnets 4 arranged in circle. The electromagnets 4 comprise a circular yoke 5, cores 6 integrally formed inside the yoke 5, coils 7 that surround the cores 6, and armatures 9 that hinge on the edge of the yoke 5 as a fulcrum 8 and are thereby supported detachably against the cores 6.

The back ends of needles 10 are brazed to the free ends of the armatures 9. The tips of the needles 10 are slidingly supported by needle guides 11, 12 and 13 fixed to a nose 14. The nose 14 is integrally formed in the housing 1. The needle guide 11, which is the closest to the opening 2 of the housing 1, contains springs 15 that forcibly detach the armatures 9 from the cores 6.

A cover 16 is attached with screws 21 to an opening edge la of the housing 1, closing the opening of the housing. Fulcrum pressure springs 17 are attached to the cover 16. These springs push the base of the armatures 9 against the yoke 5. An armature stopper 18 is fixedly mounted behind the armatures 9, the stopper 18 coming into contact with the rebounding tips of the armatures 9.

The tip of the nose 14 is located opposite to a platen 22. Recording paper 23 and an ink ribbon 24 are threaded between the tip of the nose 14 and the platen 22.

In the above setup, when a specific coil 7 is energized, the corresponding armature 9 is attracted to the corresponding core 6. This causes the needle 10 to strike the platen via the ink ribbon 24 and recording paper 23, printing a dot on the paper. Immediately after this, the armature 9 rebounds thanks to the spring 15. At this point, the armature 9 comes into contact with the armature stopper 18 and stops there.

The dot printer head of FIG. 3 has each needle 10 fixed to the tip of each armature 9. Because the needles 10 must unfailingly strike the platen 22 via the ink ribbon 24 and recording paper 23, the head structure requires its components to be positioned in such a way that each armature 9 does not contact the corresponding core 6 when attracted to the latter. As a result, the stroke of the needles 10 is held small and the gap between the tip of each needle 10 and the platen 22 is minimized.

The above-described prior art dot printer head has one distinct disadvantage. That is, the armature stopper 18 is made of rubber or like elastic substance to absorb the rebound energy of the armatures 9 and thus has a thermal expansion coefficient greater than those of metals. As a result, during an extended printing operation, the heat from the coils 7 expands the armature stopper 18 in thickness. The expanded armature stopper 18 pushes the armatures 9 in the printing direction, causing the tips of the needles 10 to protrude beyond the needle guide 13. If the printing operation is continued in this state, the actions of the armatures 9 and needles 10 fail to follow the frequency of print pulses applied to the electromagnets 4, i.e., the printing frequency. This can lead to degraded printing quality and/or to a mechanical failure such as the ink ribbon 24 getting caught by a tip of a needle 10.

One prior art solution to the above problem involves providing the housing 1 and/or the cover 16 with a large number of radiating fins 25 for higher efficiency in heat radiation. In this case, the shape of the housing 1 and/or the cover 16 tends to be complex and the cost thereof is correspondingly higher. Another prior art solution is the use of a temperature sensor which, as the temperature in the housing rises, reduces the printing speed of the printer. One disadvantage of this solution is higher cost; another is lower printing efficiency.

SUMMARY OF THE INVENTION

It is therefore an object of the present invention to provide a dot printer head capable of keeping the gap constant between the needle tips and the platen.

It is another object of the present invention to provide a dot printer head that is easy to design.

It is a further object of the present invention to provide a dot printer head that is easy to manufacture.

In achieving the foregoing and other objects of the present invention and according to one aspect thereof, there is provided a dot printer head comprising: a housing having the back end thereof opened and the front end thereof containing a needle guide; electromagnets having cores positioned opposite to armatures, the cores being wound with coils, the armatures being supported detachably against the cores, the electromagnets being contained toward the back end of the housing; needles having the back ends thereof connected to the free ends of the armatures, the tips of the needles being slidingly supported by the needle guide, the needles being pushed backwards by pressure members; and an armature stopper made of an elastic substance and fixed to the inside of a cover which closes the opening of the housing, the armature stopper being in contact with the vicinities of the free ends of the armatures; wherein the inside of the cover and the opening edge of the housing are connected using a spacer made of a substance with a linear expansion coefficient which ensures the same expansion as that of the armature stopper in thickness. When the coils of the electromagnets are energized to raise the temperature inside the housing, the armature stopper and the spacer expand by the equal length in the direction of armature stopper thickness. Thus when the armature stopper is expanded by heat, the cover is retracted exactly by the length of that expansion, allowing the armatures to return always to the same position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
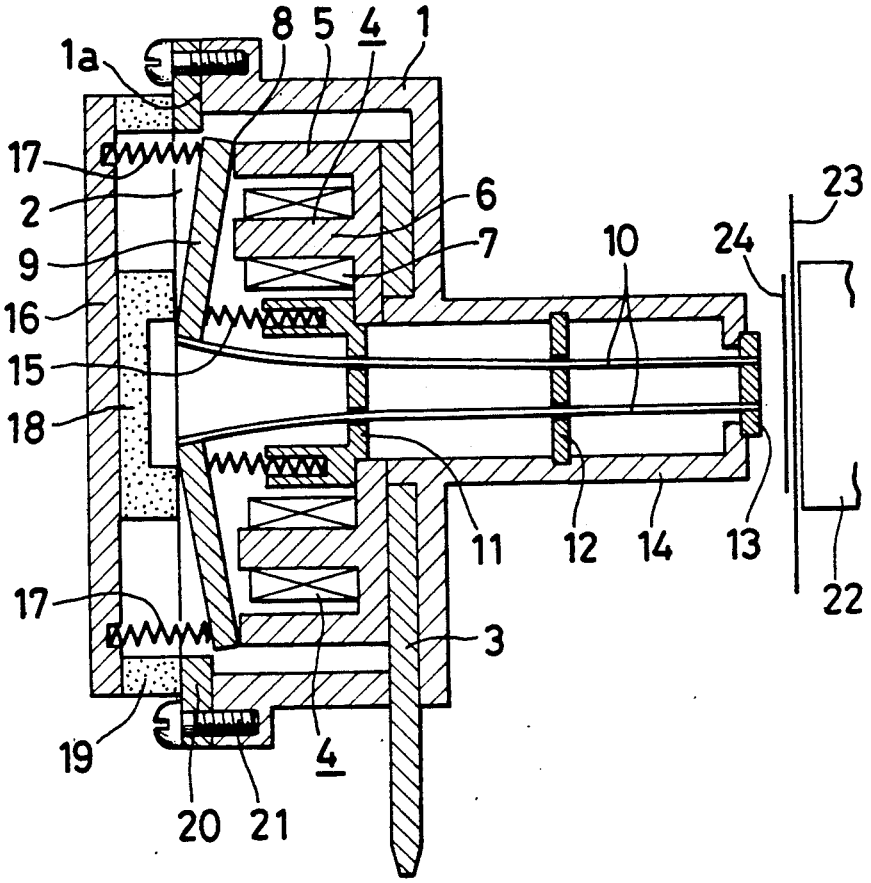
FIG. 1 is a longitudinal section of a dot printer head in its entirety as one preferred embodiment of the present invention.
Figure 2:
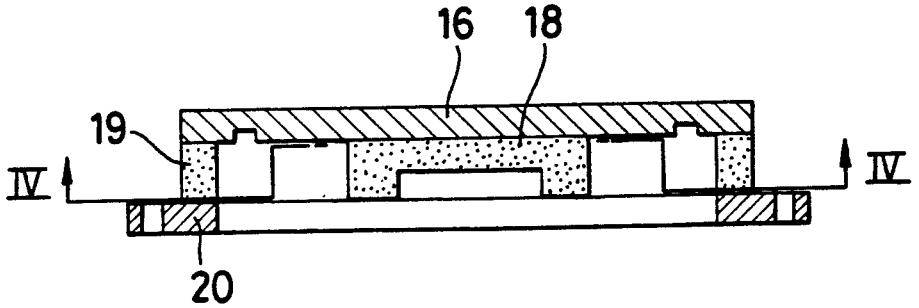
FIG. 2 is a longitudinal section of an armature stopper and a spacer as they are attached to a cover in the embodiment of FIG. 1.
Figure 3:
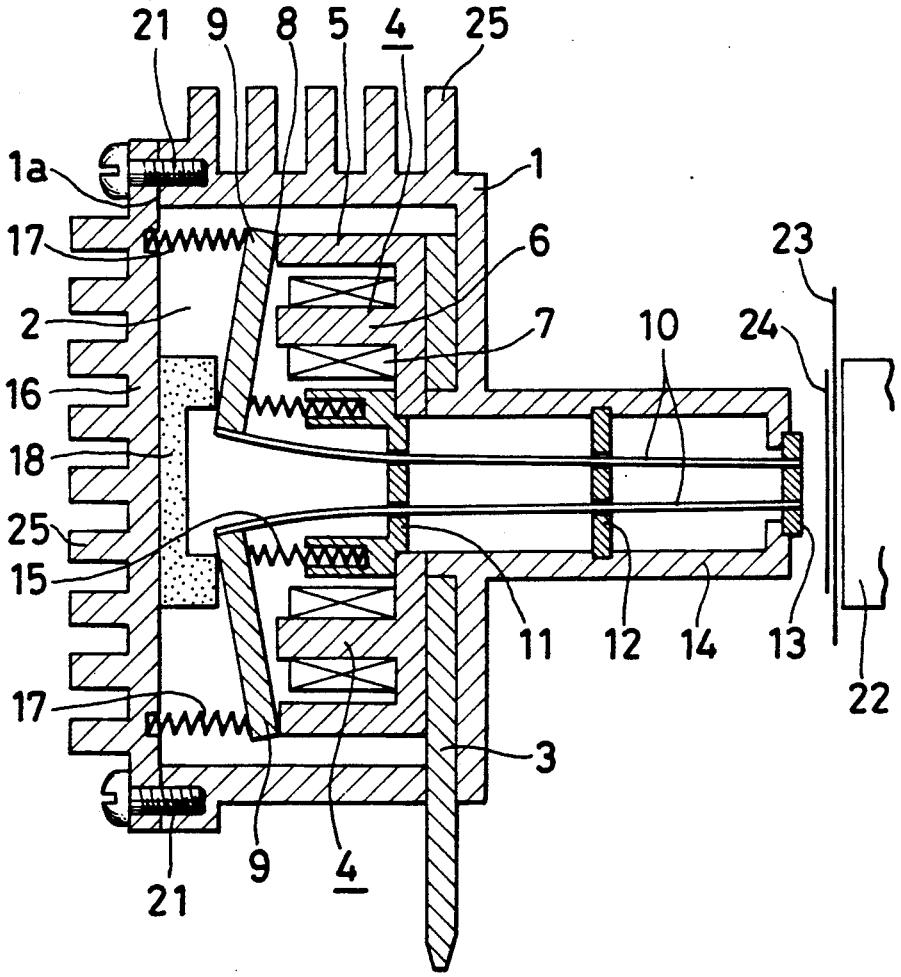
FIG. 3 (PRIOR ART)
FIG. 3 is a longitudinal section of the typical conventional dot printer head in its entirety.
Figure 4:
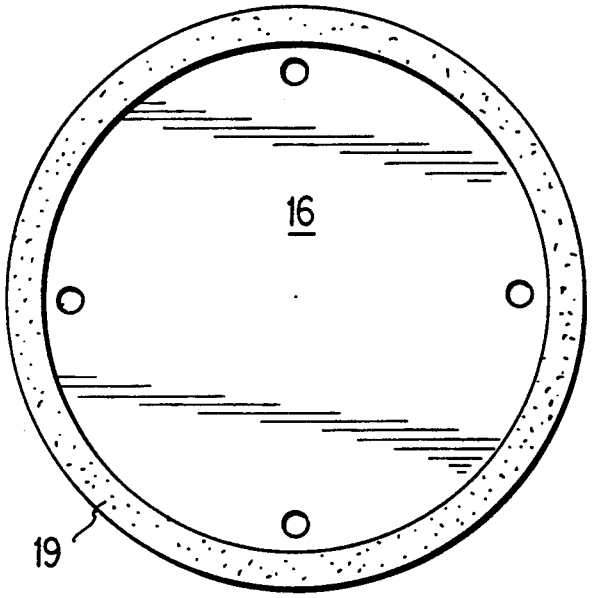
FIG. 4 is a view taken along line IV—IV in FIG. 2.

One preferred embodiment of the present invention will now be described with reference to FIGS. 1 and 2. In FIGS. 1, 2 and 4 as well as in FIG. 3, the last figure having being referenced above in describing the prior art, like reference characters designate like or corresponding parts, and any repetitive description thereof is omitted. In FIGS. 1 and 2, the cover 16 closes the opening 2 of the housing 1. The armature stopper 18 made of an elastic substance such as rubber is fixedly attached to the center of the inside of the cover 16. One end of a circular spacer 19 is secured with adhesive agent or the like to the circumference inside the cover 16. The spacer 19 is made of the same substance and has the same thickness as the armature stopper 18. The other end of the spacer 19 is secured also with adhesive agent or the like to a circular retainer plate 20. The retainer plate 20 is in turn fixedly attached to the opening edge 1*a* of the housing 1. In this structure, the cover 16 is detachably mounted on the housing 1. As shown in FIG. 2, the cover 16, the armature stopper 18, the spacer 19 and the retainer plate 20 are integrally combined to form a single unit. That face of the armature stopper 18 and that of the spacer 19 which contact the housing 1 are finished flush with each other. The outer surfaces of the housing 1 and cover 19 are formed flat with no fins provided thereon.

In the setup above, as the heat from the coils 7 raises the temperature inside the housing 1, the armature 18 and the spacer 19 expand in keeping with the rise in temperature. Although there exists a small difference between the distance from the coils 7 to the armature stopper 18 on the one hand and the distance from the coils 7 to the spacer 19 on the other, the temperature of the heat that the two parts receive from the coils 7 is substantially the same. Thus the armature stopper 18 and the spacer 19 expand by the same length with the same linear expansion coefficient. As the armature stopper 18 increases in thickness, so does the spacer 19 so that the cover 16 is detached from the opening 2 of the housing 1. As a result, the face of the armature stopper 18 on the side of the armatures 9 remains in the same position, allowing the armatures 9 to return always to the same position. With the tips of the needles 10 always returning behind the front surface of the needle guide 13 immediately after printing, there is no possibility of the needles 10 getting stuck with the ink ribbon 24. The gap remains constant between the cores 6 of the electromagnets 4 and the armatures 9 so that the armatures 9 and the needles 10 reliably follow the printing frequency. This permits high-speed printing while preventing degradation in printing quality. Because the armatures 9 always return to the same position even after the temperature rise in the housing 1, there is neither the need to provide the housing 1 and/or the cover 16 with radiating fins, nor the need to detect the temperature inside the housing 1 so as to control the printing speed. The absence of those needs translates into easier and simpler manufacture of the dot printer head and the reduced costs thereof.

In this embodiment, the armature stopper 18 and the spacer 19 are made of the same substance. For this reason, the two parts, having the same linear expansion coefficient, can be made to each have the same thickness. This connotes that there is no difficulty in designing the positions of the armature stopper 18 and the spacer 19. Furthermore, because the two parts are made of the same substance having the same linear expansion coefficient, that substance is easy to choose.

As illustrated in FIG. 2, the armature stopper 18 and the spacer 19 are fixedly attached to the cover 16, and the retainer plate 20 is secured to the spacer 19. These parts are thus connected and combine to form an integral unit. This means that manufacturing is easy; simply mounting on the housing 1 the cover 16 in the form of this unit allows the armature 18 and the spacer 19 to be secured and accurately positioned. It should be noted that because the armature stopper 18 and the spacer 19 have the same thickness, their ends may be polished after being fixedly attached to the cover 16. That is, the two parts may be readily finished to the same thickness with very high precision. In this embodiment, since the electromagnets 4 corresponding to the multiple needles 10 are arranged radially in a circular manner for higher space efficiency, the armature stopper 18 is formed correspondingly in circular pattern. This arrangement allows the armature stopper 18 to be made of a single member that serves as the stopper for all armatures 9. Manufacturing the stopper 18 as a single member improves the dimensional accuracy thereof and makes the manufacturing process simpler.

In this embodiment, the back ends of the needles 10 are fixedly attached to the free ends of the armatures 9. This arrangement eliminates the possibility of any wear between the two sets of parts and prevents degradation in positional accuracy therebetween. As a result, a constant gap is maintained between the tips of the needles 10 and the platen 22.

In practicing the invention, the armature stopper 18 and the spacer 19 may be integrally made of the same substance. Such integral design will further enhance the ease of manufacturing the dot printer head.

It is to be understood that while the invention has been described in conjunction with a specific embodiment, it is evident that many alternatives, modifications and variations will become apparent to those skilled in the part in light of the foregoing description. Accordingly, it is intended that the present invention embrace all such alternatives, modifications and variations as fall within the spirit and scope of the appended claims.

What is claimed is:

1. A dot printer head comprising:

a housing with the back end thereof opened and the front end thereof containing a needle guide;

a plurality of electromagnets positioned toward the back end of said housing, said electromagnets having cores positioned opposite to armatures, said cores being wound with coils, said armatures being supported detachably against said cores int eh lengthwise direction of said housing;

a plurality of needles having the back ends thereof connected to the free ends of said armatures, the tips of said needles being slidably supported by said needle guide;

a plurality of pressure members for pushing said needles in the retracting direction thereof;

a cover for closing the opening of said housing;

an armature stopper made of an elastic substance and fixedly attached to the inside of said cover, said armature stopper being in contact with the vicinities of the free ends of said armatures pushed in the retracting direction of said needles; and a spacer made of a substance with a linear expansion coefficient ensuring the same expansion as that of said armature stopper in a thickness direction, said spacer connecting the inside of said cover to the opening edge of said housing.

2. A dot printer head according to claim 1, wherein the free ends of said armatures are fixedly attached to the back ends of said needles and said pressure members push the free ends of said armatures, thereby pushing said needles in the retracting direction thereof.

3. A dot printer head according to claim 1, wherein said armature stopper and said spacer are made of the same substance.

4. A dot printer head according to claim 1, wherein said armature stopper and said spacer are integrally connected and made of the same substance.

5. A dot printer head according to claim 1, wherein said spacer is fixedly attached to the inside of said cover and a retainer plate is fixedly mounted on said spacer, said retainer plate being detachably attached to said housing.

6. A dot printer head according to claim 5, wherein the end of said spacer and that of said armature stopper are positioned flush with each other.

7. A dot printer head according to claim 1, wherein the outer surface of said cover is finished so as to be smooth.

8. A dot printer head according to claim 1, wherein the outer surface of said housing is finished so as to be smooth.

9. A dot printer head according to claim 1, further comprising a plurality of needles and a plurality of electromagnets, said electromagnets being arranged in a circle, the tips of said needles being arranged into at least one row.

10. A dot printer head according to claim 9, wherein said armature stopper is circular in shape.

11. A dot printer head according to claim 1, wherein said armature stopper and said spacer are made of the same substance and have the same thickness.

* * * * *